US005959528A

United States Patent [19]

Right et al.

[11] Patent Number: 5,959,528

[45] Date of Patent: Sep. 28, 1999

[54] AUTO SYNCHRONOUS OUTPUT MODULE AND SYSTEM

[75] Inventors: Robert Right, Holmes Beach; Hilario S. Costa, Sarasota; Jan A. Braam, Bradenton; Dennis Rock, Guilford; Keith Morrow, Osprey, all of Fla.; Peter Montgomery, Owen Sound, Canada

[73] Assignee: General Signal Corporation, Muskegon, Mich.

[21] Appl. No.: 09/108,722

[22] Filed: Jul. 1, 1998

[51] Int. Cl.[6] ..... G08B 29/00

[52] U.S. Cl. ..... 340/506; 340/531; 340/517; 340/519; 340/520; 340/825.06

[58] Field of Search ..... 340/506, 531, 340/517, 508, 511, 519, 520, 521, 522, 523, 825.06, 825.05

[56] References Cited

U.S. PATENT DOCUMENTS

| | | | |
|---|---|---|---|
| 4,568,919 | 2/1986 | Muggli et al. | 340/518 |
| 4,752,698 | 6/1988 | Furuyama et al. | 307/116 |
| 4,850,018 | 7/1989 | Vogt | 380/23 |
| 4,954,809 | 9/1990 | Right et al. | 340/516 |
| 4,962,308 | 10/1990 | Bormans et al. | 250/396 R |
| 5,670,937 | 9/1997 | Right et al. | 340/506 |
| 5,701,115 | 12/1997 | Right et al. | 340/286.05 |
| 5,786,757 | 7/1998 | Right et al. | 340/531 |

*Primary Examiner*—Jeffery A. Hofsass
*Assistant Examiner*—Daryl C. Pope
*Attorney, Agent, or Firm*—Ohlandt, Greeley, Ruggiero & Perle

[57] ABSTRACT

An auto synchronous output module for use at a plurality of zones in a fire alarm and detection system consisting of a power source and output devices selectively coupled to the power source so as to provide audible and visual signals, and a microprocessor within the module for coupling to a data line so as to enable transmission of data signals to and from a loop controller. Moreover, there is within the processor, responsive to an activate command from the loop controller for applying the power source to the output devices responsive to an alarm condition. In addition, within the processor, responsive to a synchronize command, sent subsequently to the activate command, from the loop controller, for applying power to the output devices in synchronism with application of other power sources to output devices at other respective modules.

8 Claims, 14 Drawing Sheets

AUTO SYNCHRONOUS OUTPUT MODULE AND SYSTEM

The present invention relates to an improvement in a fire alarm and detection system of the type previously disclosed, for example, in one of assignee's related applications entitled, "Line Monitor for Two Wire Data Transmission", now U.S. Pat. No. 5,670,937. More particularly the improvement herewith has to do with the ability to automatically synchronize the power supplied from different sources to the different alarm devices of the system.

BACKGROUND AND OBJECT OF THE INVENTION

Reference has been made above to assignee's particular fire alarm and detection system as described in U.S. patent 5,670,937. The description of that patents system is incorporated herein by reference. In essence, that system—aside from the particular line monitor feature—forms the context or environment for the inventive improvement to be described.

Other examples of prior systems of this general type can be appreciated by reference to U.S. Pat. Nos. 4,568,919, 4,752,698, 4,850,018, 4,954,809 and 4,962,308. Most of these U.S. patents describe systems that include a loop controller or the like which initiates the determination of the states of the units or transponders at various zones or stations in the system, typically by repetitive polling of the stations, whereby addresses are sent successively on the loop or lines to determine which, if any, units are in an alarm state; any units reporting an alarm state receive back from the loop controller an activate relay command. Provision is also made of most of these systems to detect and report trouble conditions.

In providing alarm signals at particular stations or locations, it is the common practice to supply power to strobes which provide flashing light and to horns which produce non-continuous sounds. However, a problem arises when the sources of light and sound are operating such that the sources lack synchronization of the power being supplied to them; hence, they will produce confusion during an alarm situation. For example, an aberrant mixture of unsynchronized light pulses or horn blasts may give rise to confusion of signals, thus frustrating efficient warning to occupants of the emergency conditions.

It can be appreciated that the desired synchronization of alarm signals from the aforesaid typical strobes and horns and the like is difficult when it has to be accomplished over large areas because there is a need to power such output devices from multiple power supplies that differ in operating characteristics.

Accordingly, it is the primary object of the present invention to improve the already known fire alarm systems of the type described in U.S. Pat. No. 5,670,937.

A further object of the present invention to solve the serious problem noted above, i.e., of satisfying the need for appropriate synchronization of alarm devices that are powered by a number of power supplies that tend to vary or drift such that, left to themselves, are not capable of remaining in complete synchronization.

Another object is to improve upon a modules previously found in the earlier fire alarm systems by providing specialized, more intelligent modules, sometimes referred to as auto synchronous output modules, that will realize the needed synchronization across many separated alarm zones.

SUMMARY OF THE INVENTION

Before proceeding with the summary of the present invention it is well to consider certain definitions: a module when referred to hereinafter is an electronic circuit that is provided at a number of zones in an alarm system and is interconnected over the same wire or pair which extends through the plurality or multiplicity of zones.

It should be especially noted, that typically, a multiplicity of modules in respective zones of an alarm system loop are in eight groups, with sixteen modules in each group, and individual units may be addressed or selected.

In fulfillment of the objects already stated a fundamental aspect of the present invention resides in the provision for overcoming the lack of synchronization of alarm devices, particularly where light strobes and horn devices are involved, that would otherwise cause rampant confusion in the alarm sounding operation which is intended to alert occupants to existing unambiguously to hazardous conditions.

A first main feature of the present invention is defined as follows with reference to the complete system:

A system for synchronizing the power supplied to alarm output devices at different zones in a life safety system, wherein the output devices are controlled by auto synchronous output modules at the respective zones and wherein the output devices are supplied with power from different power sources comprising: a loop controller at a central location; the modules including a power source and output devices; the modules being connected in groups along a data loop for first receiving activate commands, followed by synchronize commands, in the form of control signals from the loop controller so as to activate the output devices, responsive to the loop controller sensing alarm conditions at the zones; the modules including means operative when the synchronize command is received for suspending the application of power to the output devices for a predetermined time interval, whereby all activated output devices are synchronized.

Another feature resides in having an arrangement of a means for recognizing, once a first group of modules have had their separate and different power supplies synchronized, that subsequent synchronization command or signal is now being sent to additional modules, and responding thereto so as to re-synchronize said first group of modules.

Yet another feature resides in a provision or means for providing periodic re-synchronization based solely on the passage of a predetermined time interval so that the re-synchronization of the power supplied by separate sources to output devices is updated on a continuous basis.

Other and further objects, advantages and features of the present invention will be understood by reference to the following specification in conjunction with the annexed drawings, wherein like parts have been given like numbers.

BRIEF DESCRIPTION OF THE DRAWING

FIG. 8B is a timing diagram of the output device power controlled by the auto synchronous output module; FIG. 8C is the timing cycle for the device power.

DESCRIPTION OF PREFERRED EMBODIMENTS

System and Common Module Circuitry

Figure 1:
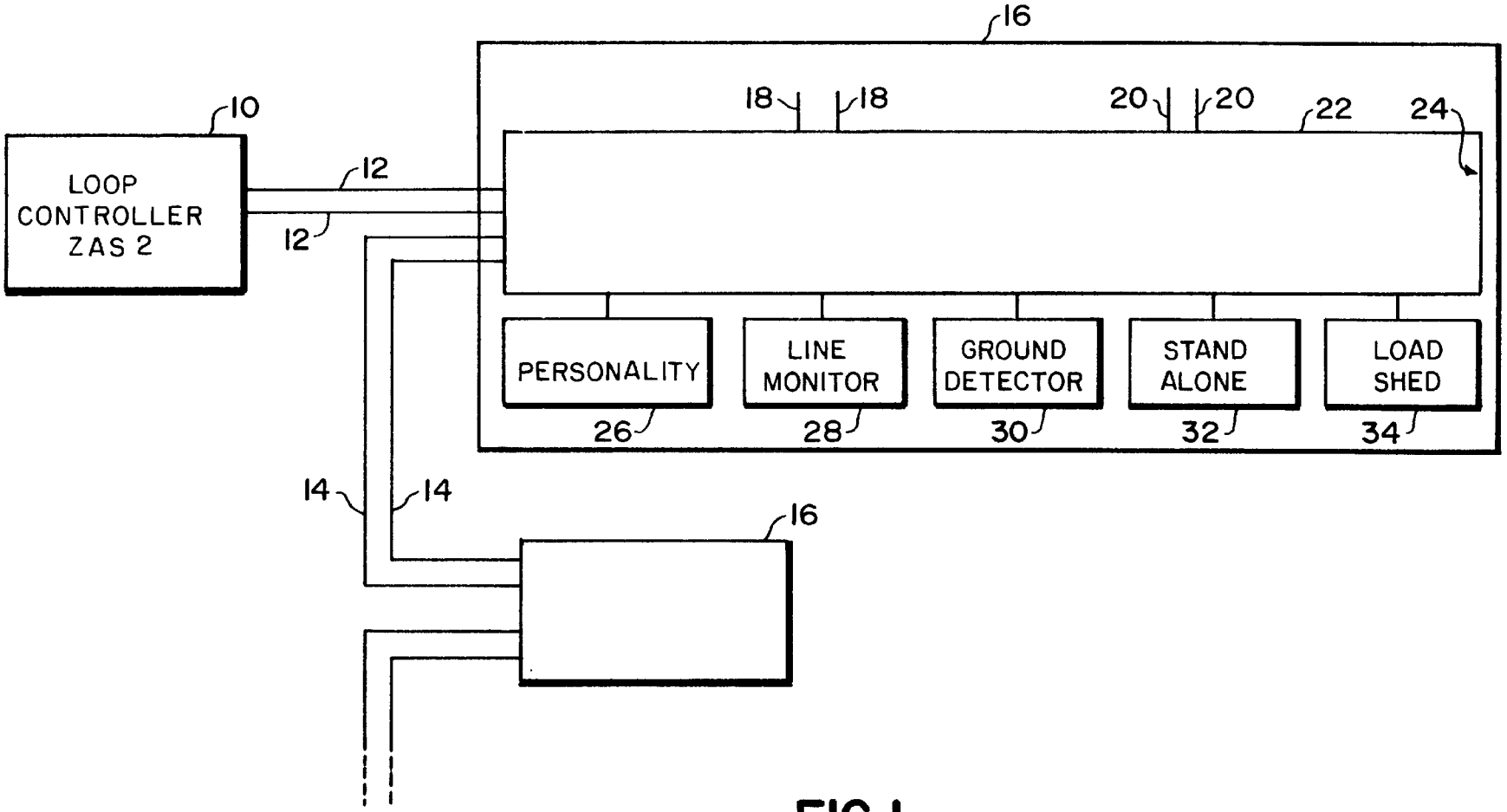
FIG. 1 is a functional block diagram which provides an simplified overview of the system in which the present invention is incorporated to constitute a unique group of transponder modules in such system.

Referring now to FIGS. 1–4 and more particularly for the moment to FIG. 1 of the drawing, there will be seen a simplified showing of the system context in which the present invention operates to fulfill the fundamental object of synchronizing the power sources in the loops of the fire detection and alarm system so as to avoid the drift from synchronism that would naturally take place.

In FIG. 1, the loop controller 10 is connected by multiple-wire outgoing and return cable 12 to a first transponder unit 16 which, in turn, is connected by a multiple-wire cable 14 to the next unit 16 and so on to other units.

Within the uppermost unit 16, there are seen a block designated 22 representing common components of a transponder module 24 whose inputs/outputs are represented by pairs of lines 18 and 20, which are supplied, typically with 24 v DC, and can be variously connected by the module to provide different modes of operation for the transponder 16. Also seen connected to the lower part of the common components 22 of the module 24 are several features forming parts of the module circuitry: a "personality" feature 26 which involves selective programming of a microcontroller, which forms the centerpiece of the module 24, such that various prescribed functions can be realized by the given module depending on the configuration code chosen. This personality feature is described and claimed in U.S. Pat. No. 5,701,115 the disclosure of which is incorporated herein by reference.

The ground fault detector feature 30 is described and claimed in docket 100.0601. The stand alone feature 32 is described and claimed in docket 100.0603 and the load shedding feature 34 is described and claimed in docket 100.0604; the details of all of the preceding features being incorporated herein by reference to their respective patent applications already noted.

Figure 2:
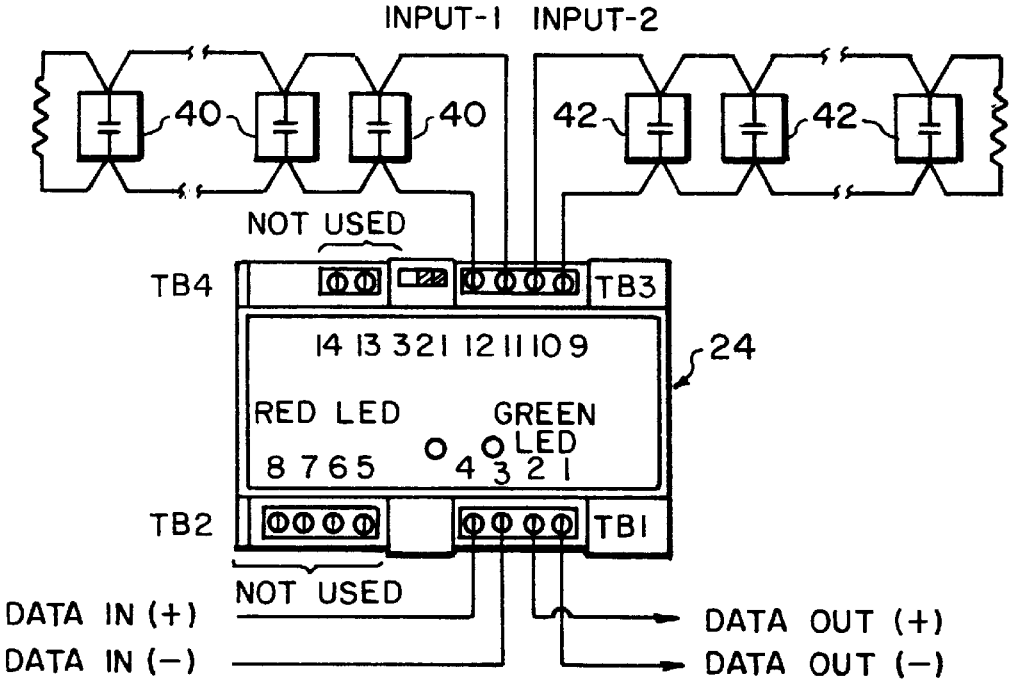
FIG. 2 is a block-schematic diagram of a class B dual input arrangement for a universal class A/B module incorporating the present invention.

Referring now to FIG. 2 of the drawing, there is depicted the module 24 which is a universal module and can be arranged, in this example, to operate class B, as a dual input module. Moreover, in this figure, connections of "data in" lines and "data out" lines are seen made to terminal blocks at the bottom of the modules, these lines corresponding, respectively, to lines 12 and 14 in FIG. 1. However, not seen in FIG. 1 are the particular class B input connections of FIG. 2, which are effectuated by the switch contacts 40, representing typical initiating devices, in input circuit 1 and, similarly, the contacts 42 in input circuit 2.

If a particular personality code, for example, personality code 1 is assigned to both of the input circuits seen in FIG. 2, this configures either one or the other or both circuits for class B normally open, involving dry contact initiating devices such as pull stations, heat detectors, etc. Consequently, when an input contact is closed an alarm signal is sent to the loop controller and the alarm condition is latched at the module 24.

Figure 3:
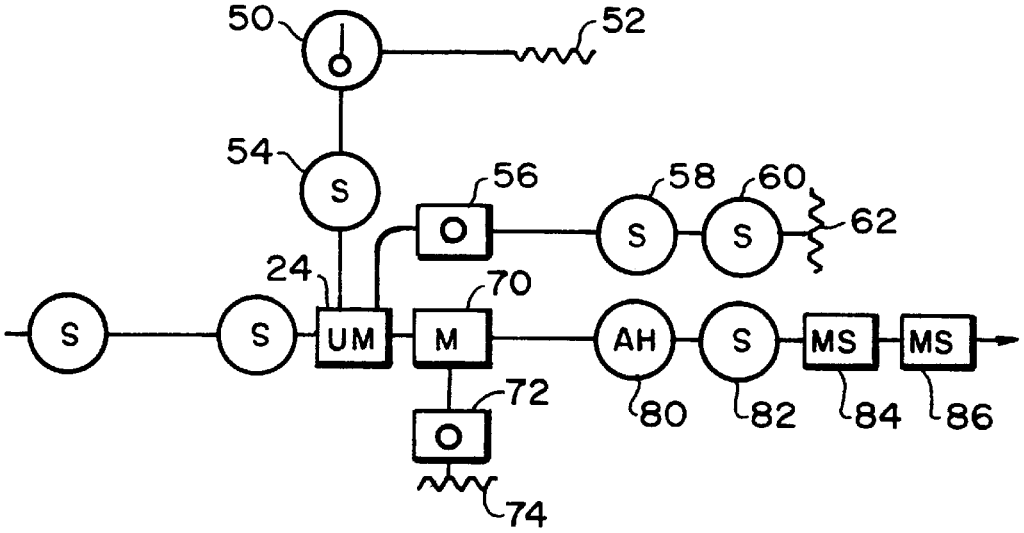
FIG. 3 is a block diagram of part of a system, and particularly illustrating a variety of devices in the form of smoke detectors and other devices connected to a universal transponder module at a given zone or station.

FIG. 3 illustrates the system where focus is on the selected circuitry or circuitry pathways extending from the universal module 24, as previously discussed, is a part of a transponder unit 16 located at a given zone or station. The module 24 is depicted in association with a variety of devices in, for example, input circuits. Such devices can be selected as a package with such universal module 24, or the module can be incorporated into an already existing system, that is, retrofitted to an older style system to bring it up-to-date. Thus, as shown in FIG. 3, two loops extend from the upper portion of the module. One loop includes a heat detector 50, an end of line resistor 52 and a conventional smoke detector 54. In the other loop there is a manual station 56, and two conventional smoke detectors 58, 60 with an end of line resistor 62 for that other loop.

Also connected to the universal module 24, in yet another loop, is a plurality of intelligent devices, including a monitor module 70 and associated therewith a manual station 72, and an end of loop resistor 74. Also extending, in a further loop, from the afore-noted monitor module 70 is an intelligent analog heat detector 80, an intelligent analog smoke detector 82, and analog manual stations 84 and 86.

FIGS. 4A through 4D and 4A' through 4C' are combined to form a schematic diagram of the module 24. The module circuitry has at the lower right in FIG. 4C the connection from the loop controller to the "data in" lines 12 at the terminals designated TB 1-4, TB 1-3; as well as the connection to the next transponder unit at another location (see at the very bottom of the figure) by way of the "data out" lines 14 from terminals TB 1-2, TB 1-1.

It will be appreciated that data communication is accomplished over the aforesaid lines, as well as synchronous, large signal, transmission. As one example, interrupt (command) signals from the loop controller are transmitted to the module 24 over the "data in" lines (designated 12 in FIG. 1), three levels of interrupt command voltages being available; that is, zero volts, 9 volts, or 19 volts can be transmitted from loop controller 10.

The loop controller sends messages out by changing the line voltage between 0, 9, and 19 volts. The devices respond by drawing 9 ma of current during specific time periods. The basic time period of the protocol is given by:

$$T = \frac{64}{32768} = 1.953 \text{ m sec.}$$

The loop controller uses a basic time period of ½ T (0.976 ms) because it has to sample the loop voltage and current in the middle of the data bits.

Figure 6:
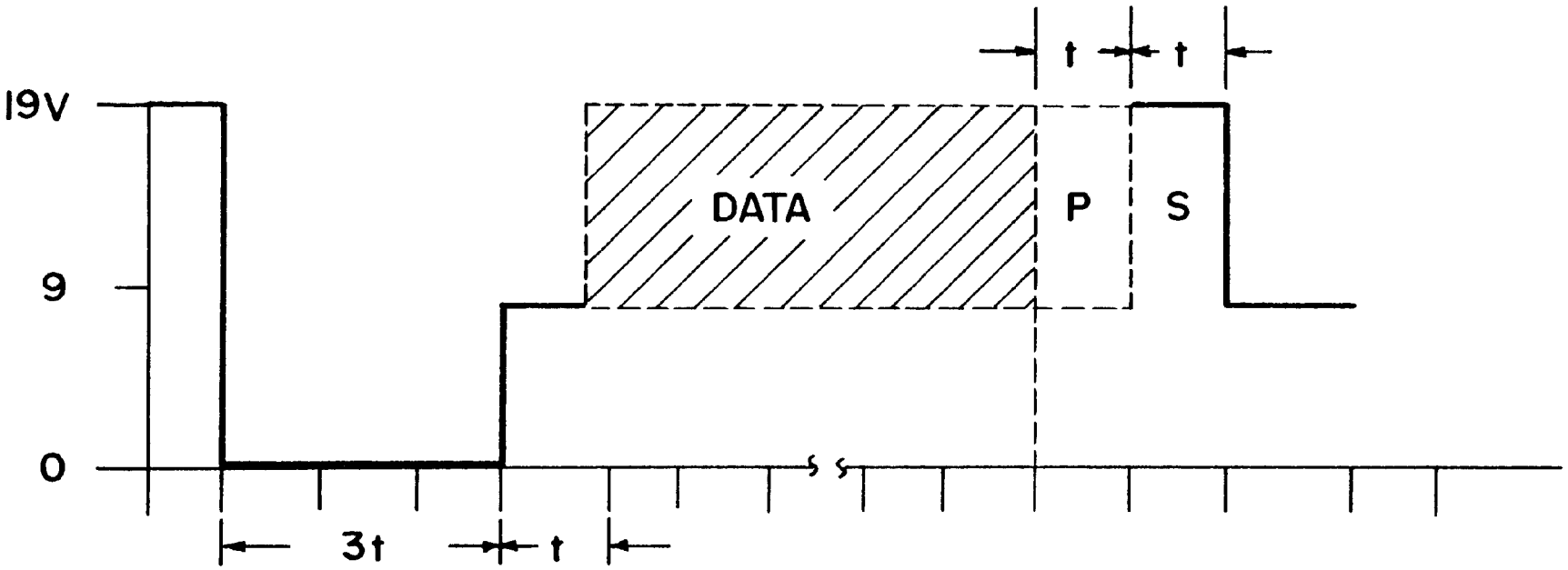
FIG. 6 is a timing diagram illustrating the application of inputs to the data lines from the loop controller.

The start-up message, or interrupt mechanism, is specific and recognized by the module as follows: (Also, see FIG. 6).

1. The line voltage (across data lines 12) is initially at 19 volts for at least 2 time periods.
2. The line is held at 0 volts for 3 time periods.
3. The line goes to 9 volts for a 1 time period—this is the wake-up or interrupt bit and modules synchronize on this edge.
4. The line alternates between 9 and 19 volts for n T periods, where n is the number of data bits in the message.

5. The parity bit (even) follows the data bits.
6. The stop bit puts the line at 19 volts for 2 T periods, then the next message may be sent.

The voltages noted above are transmitted by way of internal connection 90 to a discriminator circuit 92 at the upper left in FIG. 4, whose output is connected from the uppermost node 94 of circuit 92, via inputs 13 and 42 to input ports of microcontroller 96. The discriminator circuit 92 also includes another output, taken at note 98, to a terminal 43 of the microcontroller. This microcontroller is selected to have an NEC microprocessor therein, as well as an EE PROM 126 manufactured by EXCEL.

As will be appreciated, the discriminator circuit insures that when 19 volts is received from the loop controller, such value is sufficient to exceed the upper threshold set by the circuit and hence inputs 13 and 42 are active, whereas when only 9 v appear, only input 42 is active.

It should be noted that the centerpiece or control device for the module 24 is the microcontroller 96. A number of input/output ports (PO.O, etc.) to which connecting terminals are provided, are shown on each side of the microcontroller, as well as connections made to the top and bottom thereof. It will be noted that a ground connection is made at the bottom of the microcontroller (Vss) and a bias connection (3.3 volts) at the top terminals 25 and 28, as well as a connection from terminal 25 to terminal 29 on the right side of the microcontroller.

A group of terminals 22–27 are provided for reset and for timing control of the microcontroller, the timing control connection being made to a timing circuit 100, provided with two clocks 102 and 104.

Another group of terminals are used for reference and average bias manual connections, such being designated terminals 30, 31 and 40, the 3.3 volt bias, terminal 30 to an input/output port at terminal 5; and terminals 31 and 40 to ground.

Groups of analog/digital ports are connected to the terminals designated 33, 37–39 of the microcontroller, the first being a vector input from circuit 112; the last three—being monitoring terminals, as will be explained hereafter.

A further group of terminals 18–21 are connected to input/output ports of microcontroller 96, which are, in turn, connected to relay cards for purposes to be explained. Another terminal on the right of the microcontroller is terminal 48, connected to "load shed" line 101 for purposes explained in connection with a load shed feature in accordance with the related invention described in U.S. patent application Ser. No. 08,441,762.

Other groups of terminals, connected with output ports, appear on the left of the microcontroller. The group 53–55 is shown connected to circuitry at the lower portion of FIG. 4 and which will be explained. These output ports provide communication back to the main or control panel, terminal 53 being connected by the connecting means 110 to the output of circuit 112 at the bottom of the figure and, hence, terminal 53 connects to an input port of the microcontroller; whereas 54 and 55 connect to the respective circuits 114 and 116 which are LED circuits, that is, circuits for illuminating LED's at appropriate times. Further portions of the circuitry involve a peak detector 118 and a bias circuit 120 which, as can be seen, has the node 122 and supplies the bias of 3.3 volts for the microcontroller 96. A watchdog circuit 124 is seen immediately above the bias circuit 120, having a connection 121 to the microcontroller at terminal 62. Another group of four input/output ports is connected by respective terminals 57 through 60 to terminals of a 64 bit register 126. It will be seen that a connection from terminal 8 of the microcontroller is made to terminal 8 of register 126 for the purpose of providing a "strobe" to the register 126 in order to read the unit's identifying number stored in such register.

A reset circuit 130 furnishes a Reset+signal by way of the connection 132 to the clock circuit 100, the amplifier 133 in such circuit being biased from the 3.3 volts supply provided at node 122.

It will be noted that output terminals 18–21 of microcontroller 96 extend, by means of respective connections 150, 152, 154, and 156, to respective operational amplifiers, 160, 162, 164, and 166. The former two, that is, 160 and 162 are connected to respective ends of coil 168 and a trouble circuit 170 (which can be operated in class A, if desired), whereas, the operational amplifiers 164 and 166 are connected to opposite ends of relay coil 172, thus defining an alarm circuit 174.

Each of the relays in the trouble and alarm circuits is a double-pole, double throw, each involving four relay contacts, two being shown open and two being shown closed in each circuit.

The smoke detector 201 is seen connected across terminals TB 3-11 and TB 3-12; thence, by connecting means 203 and 205 to the respective points between pairs of alarm relay contacts 207 and 209. Alternative devices, such as bell or speaker 211 are similarly connected when called for—being accomplished—by selecting appropriate states for the relay contacts 203, 205, 207 & 209.

It will be understood that the specific type of device, i.e., bell, telephone, heat detector, manual pull station, etc., that is selectively connected to the module is dependent on the assigned personality, or set of configuration bits, that is sent to the modules memory at the time of installation (and which set can be suitably changed at a later time, as already explained). For example, if the personality that is sent to the module is "2-wire smoke detector", then non-intelligent conventional-type 2-wire smoke detectors would be connected to terminals 11 and 12. Conversely, if the personality desired was to operate bells during alarm condition, the personality "Class B or Class A Signal Output" would be assigned and bells would be connected to terminals 11 and 12, and no 2-wire smoke detectors would be allowed on this module. Likewise, other selected personalities for the module would dictate other modes of operation for that portion of the circuitry in which the devices are selectively connected.

AUTO SYNCHRONOUS MODULE FEATURE

Figure 4A:
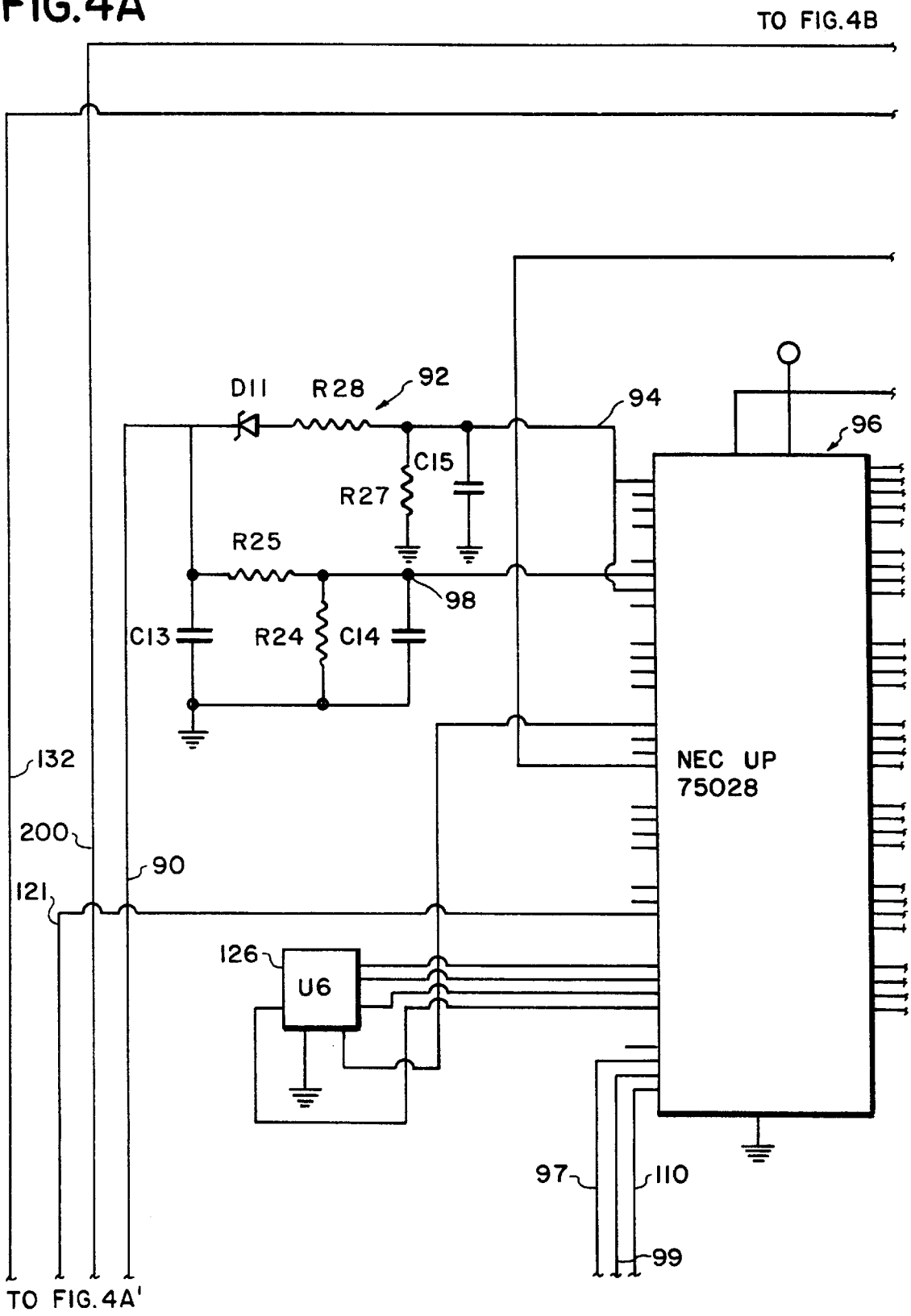
FIGS. 4A–4C is a schematic diagram of a transponder, including a module.
Figure 4A:
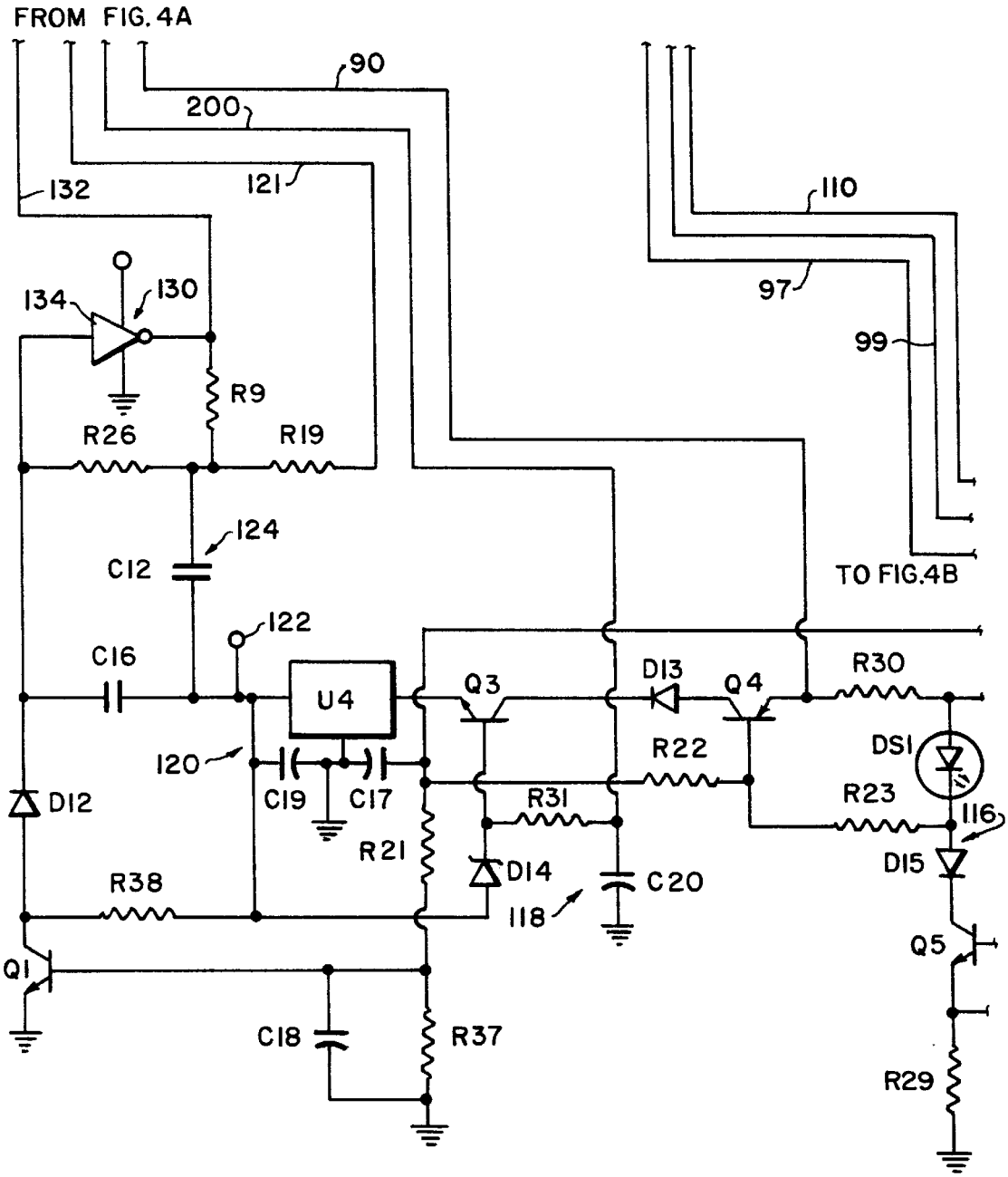
Figure 4B:
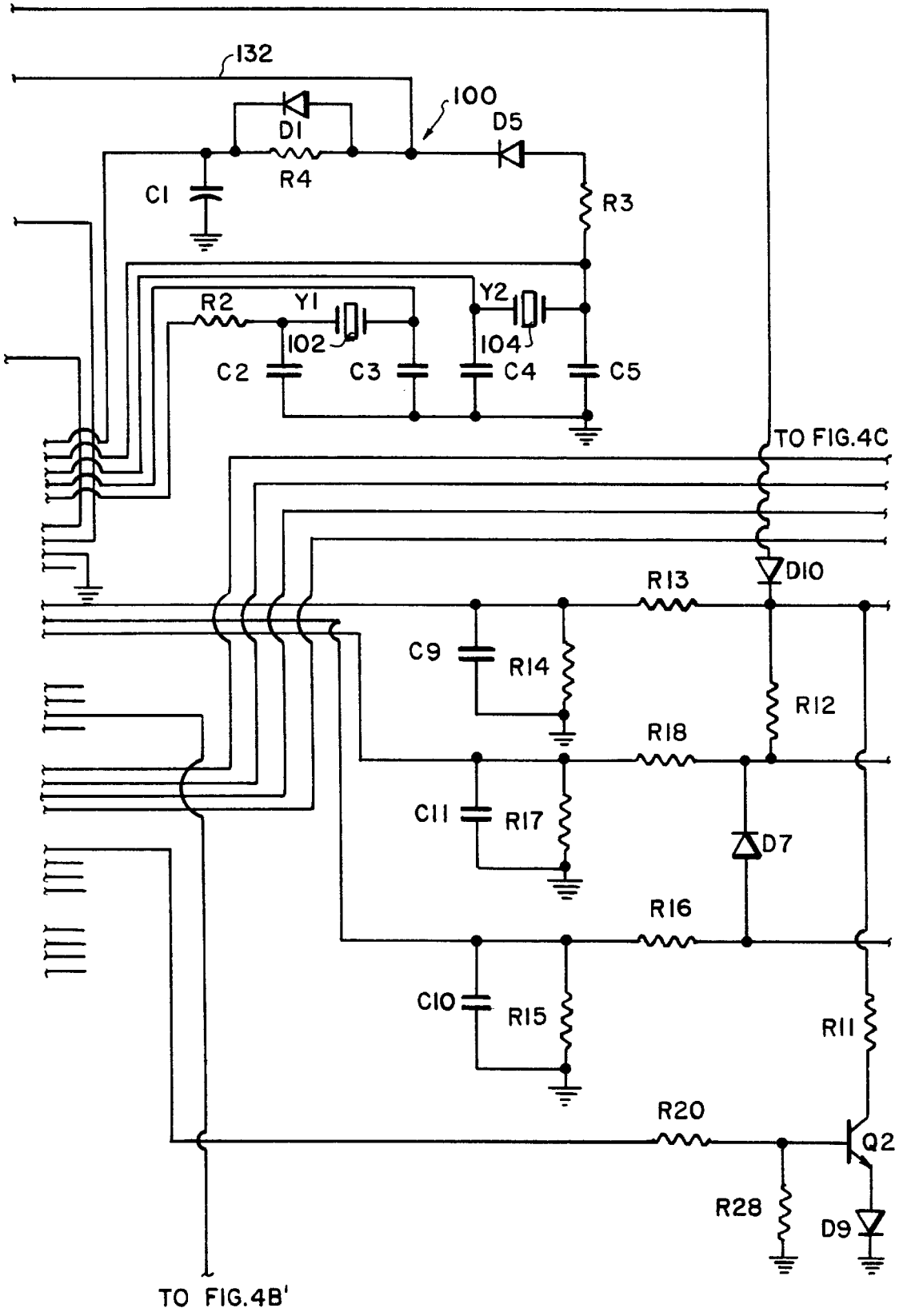
Figure 4B:
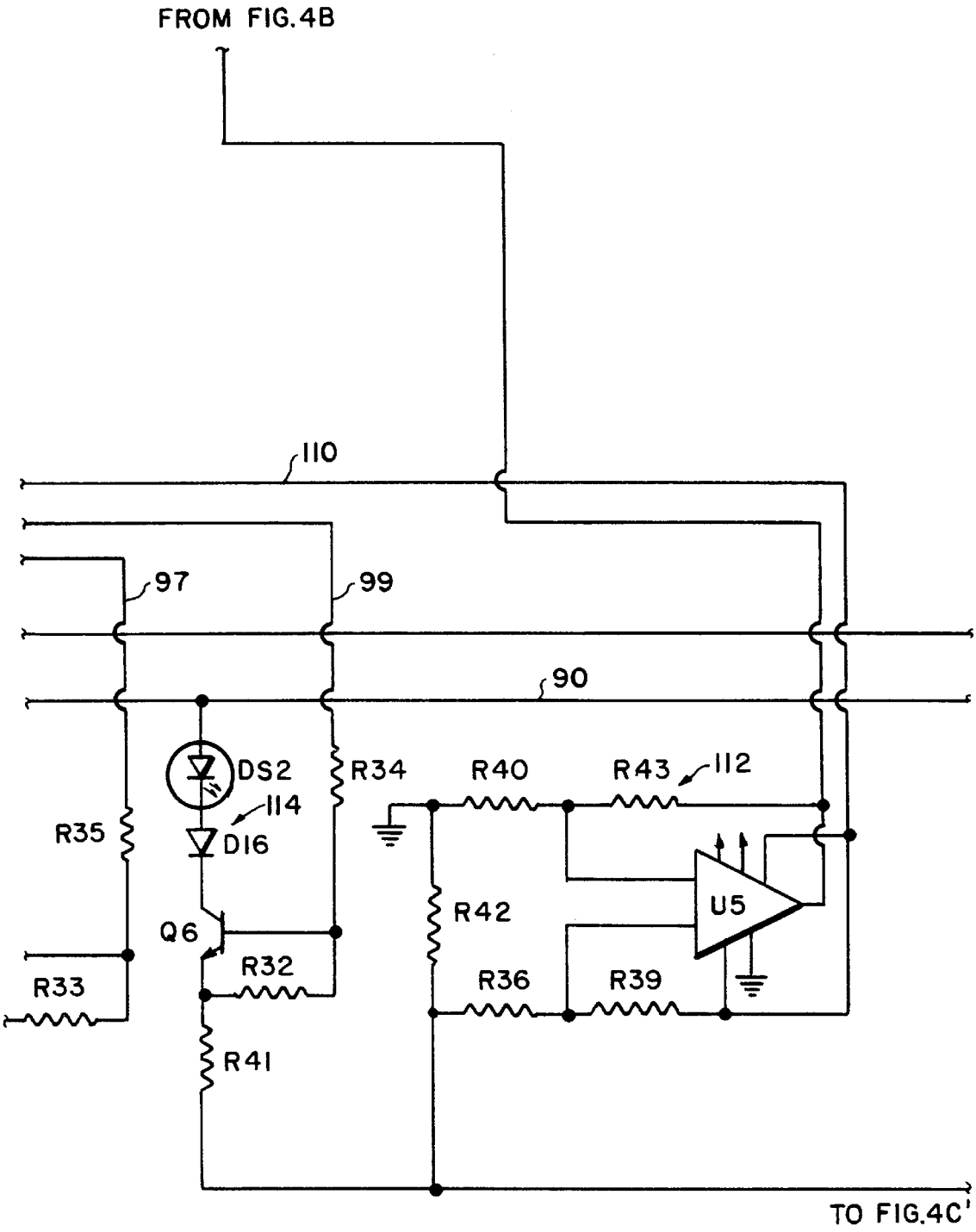
Figure 4C:
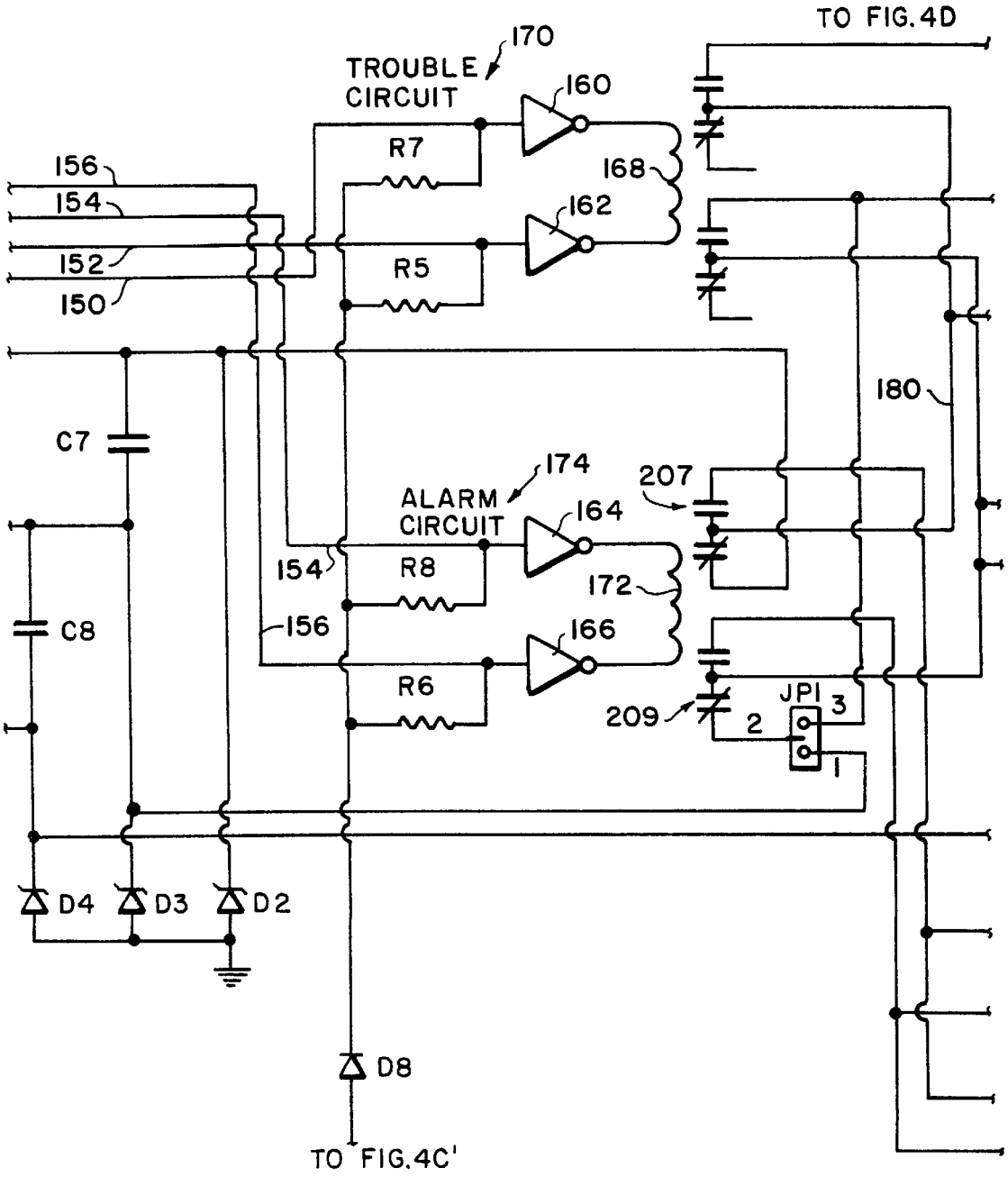
Figure 4C:
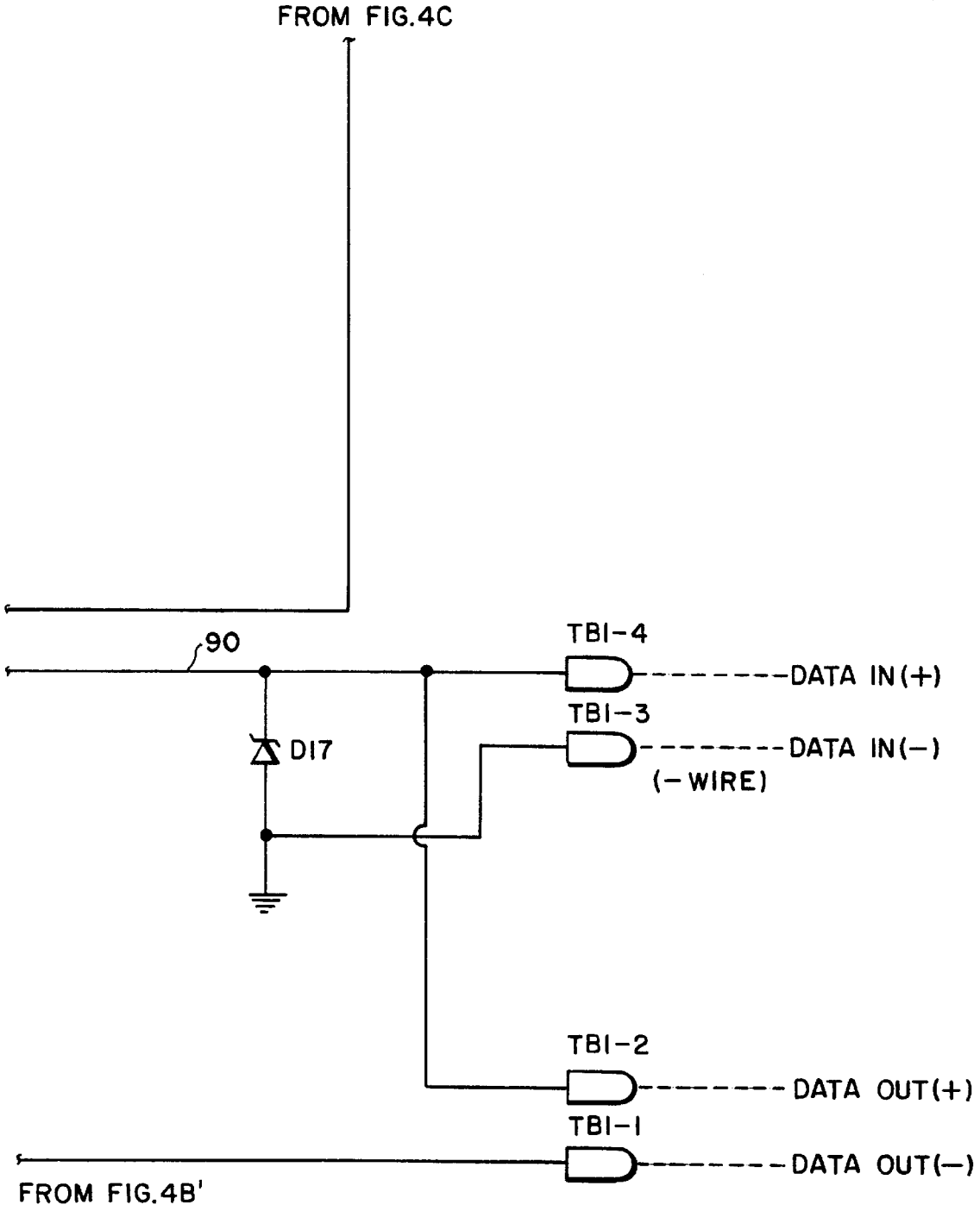
Figure 4D:
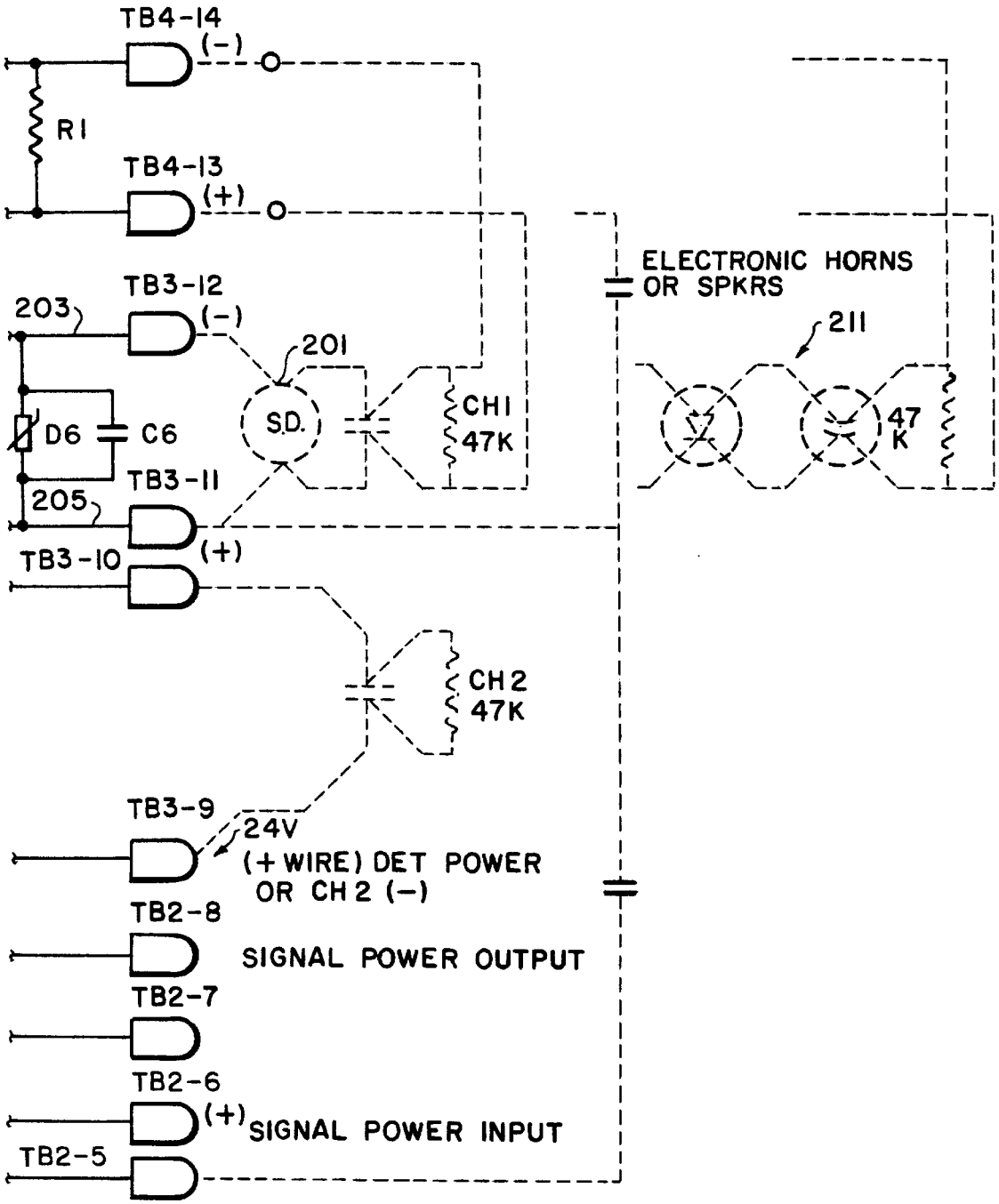
Figure 5:
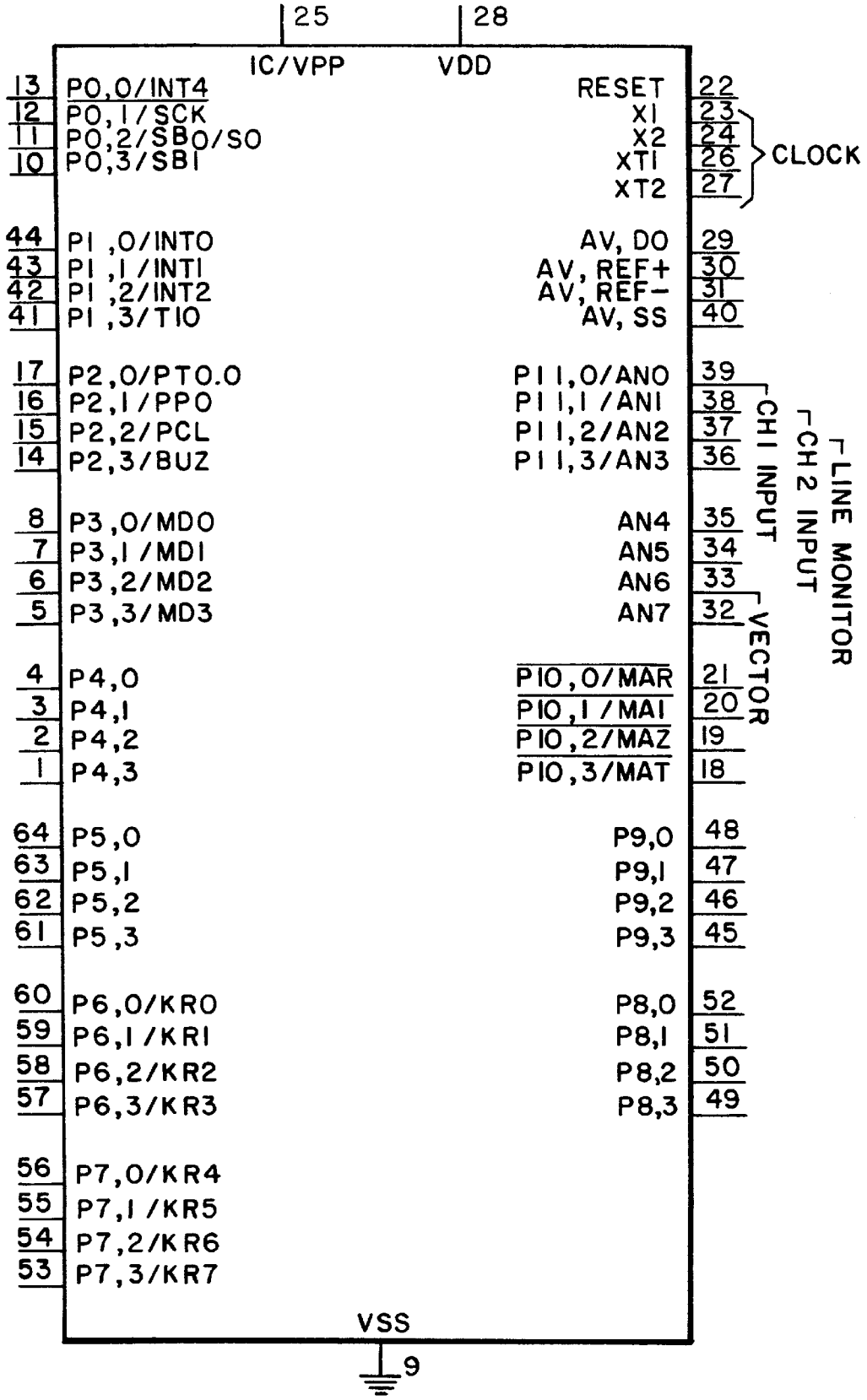
FIG. 5 is a magnified view of the microcontroller of the universal module of FIG. 4A.
Figure 7:
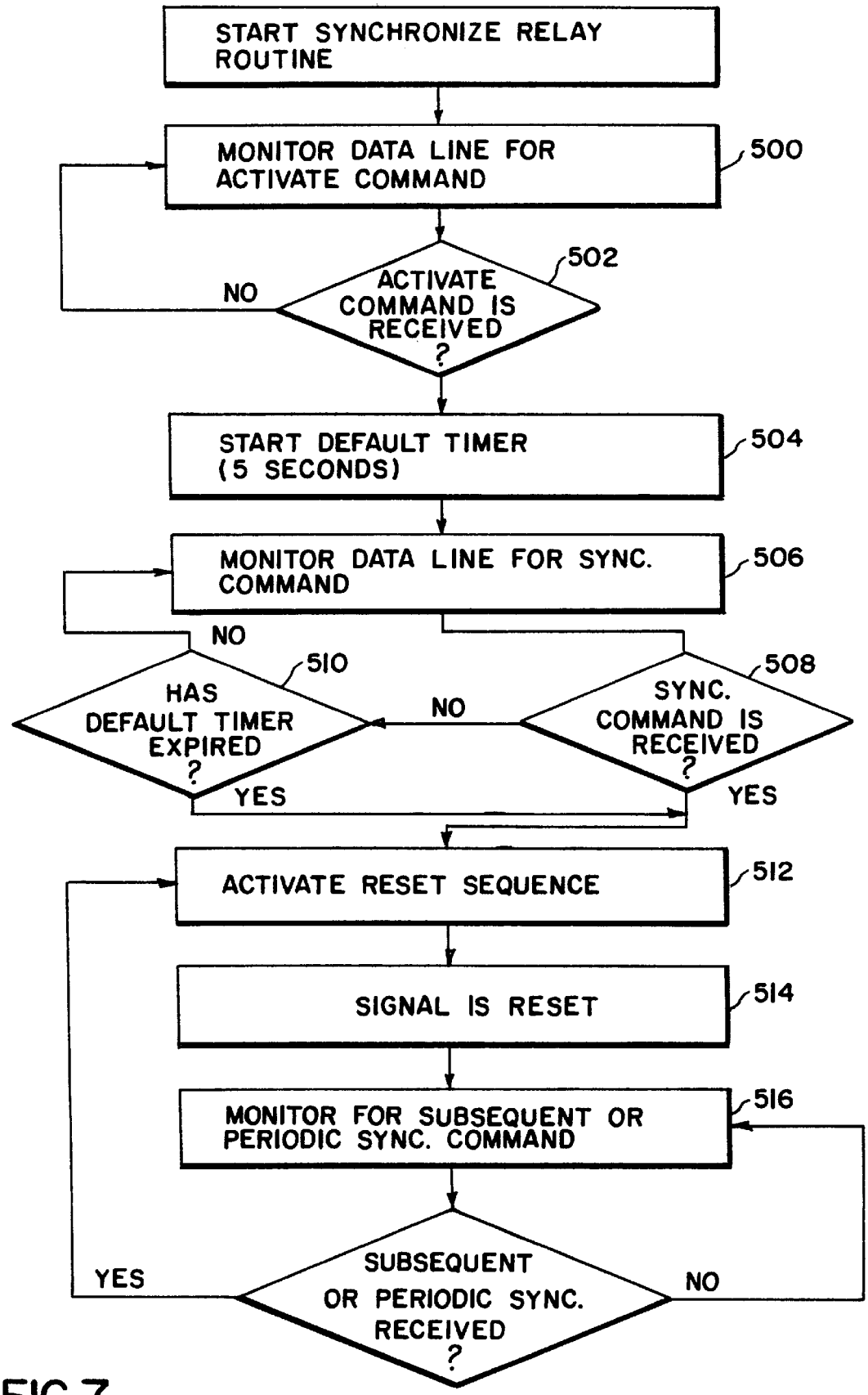
FIG. 7 is a flow chart of the firmware within the microprocessor forming part of the auto synchronous output module of the present invention, such firmware incorporating the synchronous relay routine to be carried out by the microprocessor or microcontroller in response to the instructions embodied in the programmed firmware.

Referring now to FIGS. 7 and 8, there is seen in the first of these figures a flow chart that depicts the logical steps or operations in a routine performed in accordance with programming means sometimes referred to as "firmware", embedded within the microcontroller 96 seen in FIG. 4A.

As has been noted before, an appropriate activate command (FIG. 8), for example, a command signal of approximately 19 volts, is sent from the loop controller 10 seen in FIG. 1 to the modules 24 at each of the zones which are serviced by a given loop or two-wire line such as 12—12 or 14—14. Specifically, the signals corresponding to an activate command are sent out on the loop or line in response to one or more modules indicating to the loop controller that each of them is in alarm.

It will be understood that, after so indicating an alarm state, a given module then performs a step or operation, represented by block 500 in FIG. 7, of monitoring the data line or loop for an activate command which is expected to follow. When the activate command is indeed received, (Yes output of decisional block 502) the next operation proceeds which is represented by block 504, whereby a default timer is started and operates for 5 seconds prior to a synch command being received. If the default timer runs for the full 5 seconds indicated, then an output signal will be transmitted from the controller 96 to the relay 172 seen in FIG. 4C. Closure of normally open contacts of the relay will cause 24 volts from a separate power source to be applied to the electronic horns and strobe lights 211 of the given installation. In this case, the desired synchronism of power sources is not realized.

As just noted, a default operation occurs if the synchronize command does not follow the activate command within the default period. However, while the monitoring step represented by block 506 is being carried out, i.e., the module 24 is awaiting a synch command (FIG. 8) from the loop controller 10. The synch command signal will eventually produce the requisite synchronization of multiple modules that have been placed in alarm and which may be in a variety of loops or data lines. Without this feature, there is the problem already described of causing confusion due to the fact that different power supplies are furnishing power to spaced output devices, e.g., strobe lights and horns, in the system. As has been explained, this is due to the fact that different power sources tend to drift slightly from each other and hence lose synchronism over time.

At the next step or operation of the programming routine, represented by decisional block 508, a determination is made as to whether the synch command has been received. It will be understood particularly by referring to FIGS. 8A and 8B, and particularly for the moment to FIG. 8B, that once the synch command is received at time t1, there is a time delay of 2 milliseconds before a synch pulse of 20 milliseconds duration from the module 24 appears, the effect of which is to cause power drop-out. The drop-out period is seen in FIG. 8B extending from the synch pulse edge 600 to edge 602. During this period, with the relay 172 de-energized, hence, its contacts being open, no power is being supplied to the output devices 211. However, this drop-out period ends as the voltage rises as shown by the edge 602 to the 24 volt value. It will be noted that the decisional block 510 provides the operation of checking on whether the default timer period has expired.

The step or operation represented by block 512 is logically connected to 508 and 510 such that in either event, that is, if the default time has expired or if the synch command has been received there will be activation of a reset sequence. In case of a default time having expired, power is applied to output devices from the controller 96 through the closure of contacts of relay 172; but in the event the synch command has been received, the synch pulse indicated in FIG. 8B will carry out its function of causing power drop-out as already explained, with the ultimate effect of causing all of the modules that have been activated to be reset and therefore to be synchronized at approximately the same instant of time. This is indicated by the operations designated, "Activate Reset Sequence" (512) and "Signals Reset" (514).

Several additional synchronization schedules or schemes are also features of the present invention. Thus subsequent steps or operations represented by blocks 516 and 518 are carried out, by which resynchronization is achieved of a previously synchronized group of auto synchronous output modules when another module or modules on the same loop are being synchronized. This will be appreciated by reference to FIG. 8A which shows a timing diagram over a significantly longer period than that seen in FIG. 8B. In this diagram one sees the activation of a series or group of ASO modules ASO #1, #2 and #3, as well as ASO #N−1 and ASO #N. Further along the timing diagram is ASO N+1. Thus it will be seen that the synchronize—commands all active—pulse 604 will cause synchronization of the modules ASO #1 through N that have already been activated. Likewise, after a period of five minutes, there will be a periodic synchronization command transmitted such that if there has been any drift since the original synchronization by 604 then this further pulse called a periodic pulse 606 (e.g., every five minutes) will cause resynchronization of ASO #1—ASO #N.

Figure 8A:
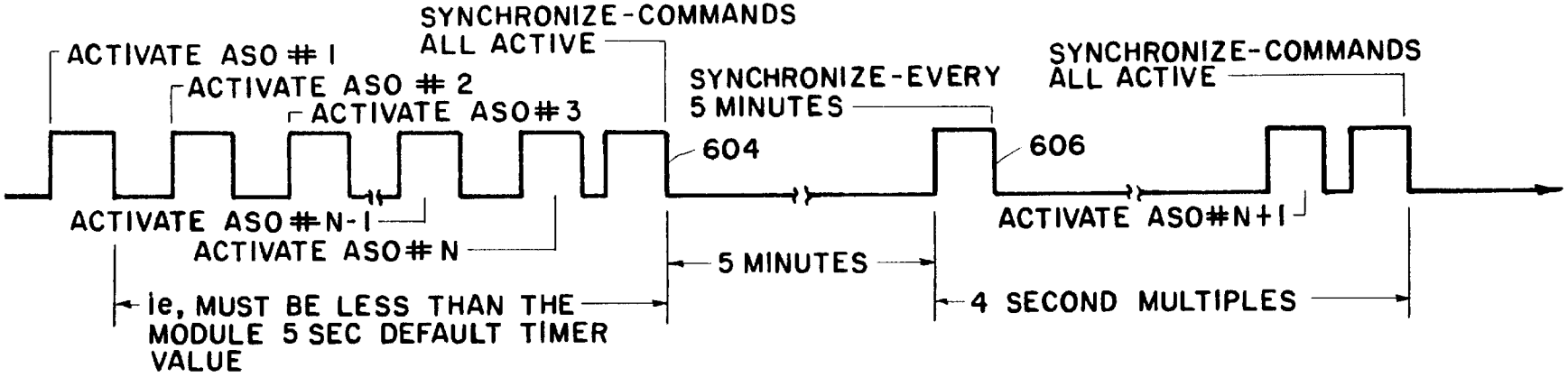
FIGS. 8A–8C is a timing diagram of the activate command and synchronize command signals which are sent from the loop controller.
Figure 8B:
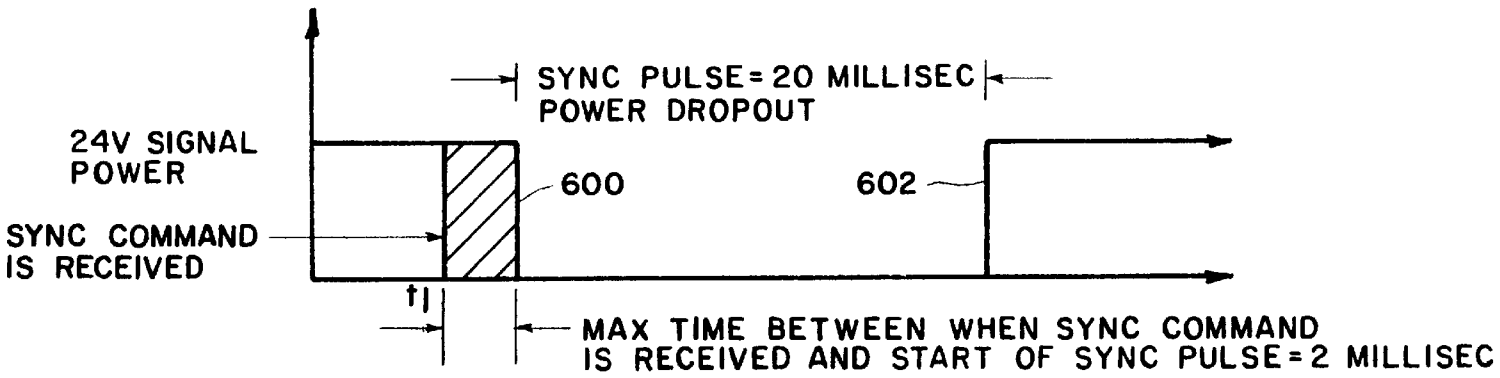
Figure 8C:
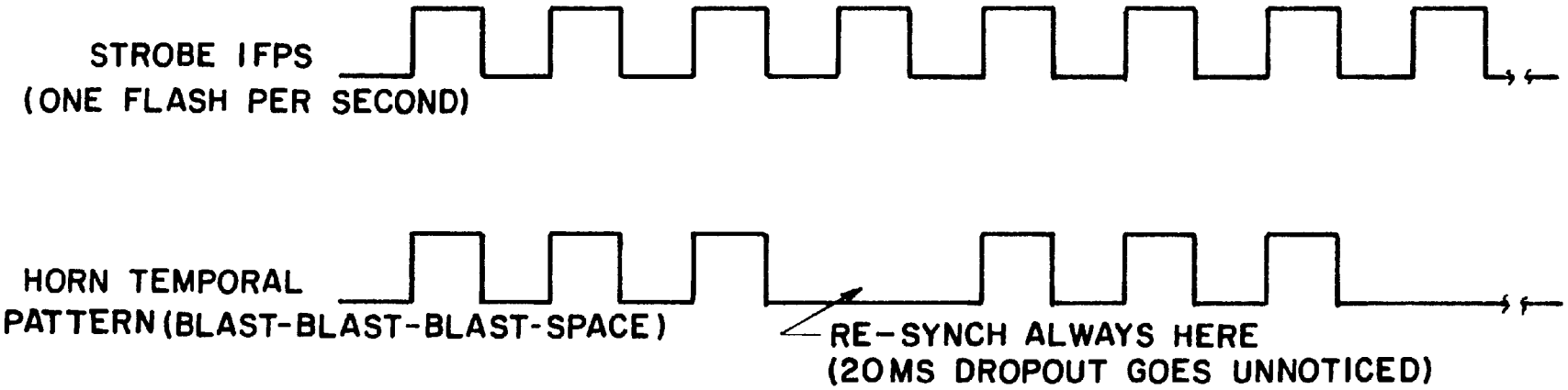

Further on in the timing diagram of FIG. 8A, it will be seen that at some point another module ASO N+1 may be activated and this will cause re-synchronization of all the prior modules ASO #1 through ASO #N just because this ASO N+1 is in the process of being synchronized with the other modules in its group or loop. In order not to interfere with the normal timing of power application to the output devices, i.e., to the strobes and horns 211, the desired re-synchronization is timed to occur, as seen in FIG. 8C, during a "space" (time interval) between horn blasts; as well as between strobe flashes.

It will be understood by those skilled in the art that flow chart of FIG. 7 represents the software aspect of the present invention. Thus, a series of logical steps or operations, in accordance with the process, as well as the means for performing such steps, is illustrated by the blocks 500 to 518. It will be apparent that the particular hardware can take a variety of forms but essentially well-known and conventional devices such as storage means, (for example, the storage device 126 seen in FIG. 4A), are utilized, as well as flip-flops, timing devices and a variety of logic circuits, to perform the required functions, thereby to achieve the primary object, namely, of overcoming the lack of synchronization of output devices that might otherwise occur.

The invention having been thus described with particular reference to the preferred forms thereof, it will be obvious that various changes and modifications may be made therein without departing from the spirit and scope of the invention as defined in the appended claims.

We claim:

1. An auto synchronous output module for use at a plurality of zones in a fire alarm and detection system comprising:

a power source and output devices selectively coupled to the power source so as to provide audible and visual signals;

a microprocessor within the module for coupling to a data line so as to enable transmission of data signals to and from a loop controller;

means within the processor, responsive to an activate command from the loop controller for applying the power source to the output devices responsive to an alarm condition; and means within the processor, responsive to a synchronize command sent, subsequently to the activate command, from the loop controller, for applying power to the output devices in synchronism with application of other power sources to output devices at other respective modules.

2. A module as defined in claim 1, in which the means for applying power to particular output devices in synchronism with applying power to output devices at other respective modules includes means for interrupting power to all the devices for a predetermined interval and then reapplying power.

3. A system for synchronizing the power supplied to alarm output devices at different zones in a life safety system, wherein the output devices are controlled by auto synchronous output modules at the respective zones and wherein the output devices are supplied with power from different power sources comprising:

a loop controller at a central location;

the modules including a power source and output devices;

the modules being connected in groups along a data loop for receiving activate commands in the form of control signals from the loop controller so as to activate the output devices responsive to alarm conditions at the zones;

the modules including means operative when an activate command is received for suspending the application of power to the output devices for a predetermined time interval until a subsequent, synchronize command is received, whereby all activated output devices are then synchronized.

4. A system as defined in claim 3, wherein all activated output devices are synchronized by a synch pulse signal, including means for responding to the synch pulse signal so as to interrupt the connection of the power sources to their respective output devices.

5. A system as defined in claim 3, further including means for responding, following initial synchronization at predetermined modules, to the subsequent synchronization at other modules wherein said predetermined modules are then operative to resynchronize the application of power to their alarm output devices.

6. A system as defined in claim 3, further comprising means for providing resynchronization of all already synchronized modules after the passage of a predetermined period.

7. A system as defined in claim 4, wherein said means for responding to the synch pulse signal includes a relay connected to said microprocessor for receiving said signal therefrom.

8. A system as defined in claim 1, in which there are eight groups of said modules in each data loop, sixteen modules being in each group.

* * * * *